US005652777A

United States Patent [19]

Nagai et al.

[11] Patent Number: 5,652,777

[45] Date of Patent: Jul. 29, 1997

[54] DIAGNOSTIC X-RAY APPARATUS

[75] Inventors: Seiichiro Nagai; Akira Tsukamoto; Koichiro Nabuchi; Masayuki Nishiki, all of Tokyo, Japan

[73] Assignee: Kabushiki Kaisha Toshiba, Kanagawa-ken, Japan

[21] Appl. No.: 360,931

[22] Filed: Dec. 21, 1994

[30] Foreign Application Priority Data

Dec. 22, 1993 [JP] Japan ..... 5-323493

[51] Int. Cl.[6] ..... H05G 1/22

[52] U.S. Cl. ..... 378/98.2; 378/106

[58] Field of Search ..... 378/96, 98, 106, 378/98.2, 98.3, 98.7, 98.8, 101, 108, 109, 110, 111, 112

[56] References Cited

U.S. PATENT DOCUMENTS

| | | | |
|---|---|---|---|
| 4,991,192 | 2/1991 | Nishiki | 378/106 |
| 5,101,421 | 3/1992 | Nishiki | 378/106 |
| 5,187,730 | 2/1993 | Fujihara | 378/98.7 |

*Primary Examiner*—Don Wong

*Attorney, Agent, or Firm*—Finnegan, Henderson, Farabow, Garrett & Dunner, L.L.P.

[57] ABSTRACT

A diagnostic X-ray apparatus includes an X-ray tube, an image intensifier for converting an X-ray image of an object under examination to an optical image, a solid state image sensor device for detecting the optical images produced by the image intensifier and converting the optical means into a series of video signals, a CCD driver generating field shift pulses for driving the solid state image sensor device at a predetermined rate, pulse width determining means for determining a pulse width of the X-ray pulses, and X-ray control means for controlling an emission period and timing of the X-ray pulse emitted from the X-ray tube. In the case that the solid state image sensor device performs interlaced scanning in a field storage mode, commencing with the second frame when the field shift pulse is generated by the CCD driver, the X-ray pulse continues to be emitted from the X-ray tube for a half of the pulse width determined by the pulse width determining means in the first frame. In case that the solid state image sensor device performs interlaced scanning in a frame storage mode, X-ray pulses having a pulse width determined by the pulse width determining means are emitted in the same field of each frame.

19 Claims, 11 Drawing Sheets

PIXEL MATRIX OF CCD

| | | | | | |
|---|---|---|---|---|---|
| 1A | 1B | 1C | 1D | 1E | 1F |
| 2A | 2B | 2C | 2D | 2E | 2F |
| 3A | 3B | 3C | 3D | 3E | 3F |
| 4A | 4B | 4C | 4D | 4E | 4F |
| 5A | 5B | 5C | 5D | 5E | 5F |
| 6A | 6B | 6C | 6D | 6E | 6F |

READ OUT PIXEL DATA IN THE FIRST FIELD

| | | | | | |
|---|---|---|---|---|---|
| 1A | 1B | 1C | 1D | 1E | 1F |
| 3A | 3B | 3C | 3D | 3E | 3F |
| 5A | 5B | 5C | 5D | 5E | 5F |

ODD-NUMBERED SCANNING LINES

READ OUT PIXEL DATA IN THE SECOND FIELD

| | | | | | |
|---|---|---|---|---|---|
| 2A | 2B | 2C | 2D | 2E | 2F |
| 4A | 4B | 4C | 4D | 4E | 4F |
| 6A | 6B | 6C | 6D | 6E | 6F |

EVEN-NUMBERED SCANNING LINES

FIG. 3

DIAGNOSTIC X-RAY APPARATUS

BACKGROUND OF THE INVENTION

1. Field of the Invention

The present invention relates to a diagnostic X-ray apparatus for emitting X-ray pulses for examining an object and including a solid-state image sensing device for providing an image signal for display of an X-ray radiographic image.

2. Description of the Related Art

In a known diagnostic X-ray apparatus, an X-ray directed from an X-ray tube toward an object under examination and transmitted through the object is converted into an optical image by an image intensifier (I.I.). This optical image is picked up by a TV camera, and is converted into an image signal for display as a fluoroscopic image on a monitor. The image signal is converted into a digital form by an A/D converter, and various kinds of image processing are performed, as needed.

In a conventional TV camera, an interlaced scanning system is employed to respectively scan odd- and even-numbered horizontal scanning lines in odd-and even-numbered fields. In recent years, a solid-stage imaging device such as a charge-coupled device (CCD) is often used as the TV camera. The type of solid-state imaging device is divided into a field storage mode and a frame storage mode with regard to a storing mode of signal charges.

In the field storage mode, each pixel stores signal charges during only a field period. Two pixels adjacent to each other in the vertical direction are read as one pixel, and these two pixels are shifted upward or downward by one pixel in the odd-or even-numbered field. More specifically, two horizontal scanning lines of the imaging device are used as one horizontal scanning line of a TV signal in the field storage mode.

In the frame storage mode, each pixel stores signal charges during a frame period. The charges of the pixels of the odd-numbered horizontal scanning lines are read in the odd-numbered fields, and the charges of the pixels of the even-numbered horizontal scanning lines are read in the even-numbered fields. More specifically, each horizontal scanning line of the imaging device is used as the corresponding horizontal scanning line of a TV signal.

For a diagnostic X-ray apparatus including a CCD performing interlaced scanning in a field storage mode, an X-ray pulse having a predetermined pulse width is emitted from the X-ray tube and a pulse width of the X-ray pulse emitted from the X-ray tube is one-half of the predetermined pulse width when a field shift pulse is generated by a pulse generator. The predetermined pulse width is decided according to a preliminary X-ray emission.

For a diagnostic X-ray apparatus including a CCD performing interlaced scanning in a frame storage mode, the X-ray pulse having the predetermined pulse width is emitted from the X-ray tube and a series of video signals is generated by the CCD at the timing shown in FIG. 1 or FIG. 2. The predetermined pulse width is decided according to a preliminary X-ray emission.

In FIG. 1, the X-ray pulse is emitted from the X-ray tube in the first field period of the first frame period and each pixel of the CCD stores signal charges corresponding to this X-ray pulse emission. The charges of the pixels on the even-numbered horizontal scanning lines are read in the second field of the first frame, and the charges of the pixels of the odd-numbered horizontal scanning lines are read in the first field of the second frame.

In FIG. 2, the X-ray pulse is emitted from the X-ray tube in the second field period of the first frame period and each pixel of the CCD stores signal charge corresponding to this X-ray pulse emission. The charges of the pixels on the odd-numbered horizontal scanning lines are read in the first field of the second frame, and the charges of the pixels of the even-numbered horizontal scanning lines are read in the second field of the second frame.

With reference also to FIG. 3, the charges of the pixels on the odd-numbered horizontal scanning lines are read in the first field of each frame and the charges of the pixels on the even-numbered horizontal scanning lines are read in the second field of each frame.

Thus, in the case as shown in FIG. 1, the first output field image signal is the even field image signal, and in the case as shown in FIG. 2, the first output field image signal is the odd field image signal. For example, when the image signal is stored in a frame memory, it is possible that the exact frame image signal is not provided. This is because the field image signal provided to the frame memory first is stored at a predetermined region of the frame memory.

SUMMARY OF THE INVENTION

It is an object of the present invention to provide a diagnostic X-ray apparatus which uses a solid-state image sensing device capable of obtaining a proper contrast radiographic image successively without a preliminary X-ray emission.

In accordance with the present invention there is provided a diagnostic X-ray apparatus for emitting X-ray pulses for examining an object. The apparatus comprises a source for emitting X-ray pulses toward the object; optical imaging means for receiving the X-ray pulses through the object and converting the X-ray pulses to corresponding optical images; video means, including a solid-state image sensor means, for detecting the optical images produced by the optical imaging means and for converting the optical images into a series of video signals; synchronizing means for generating field shift pulses for driving the solid-state imaging sensor means at a predetermined rate; pulse width determining means for determining a pulse width of the X-ray pulse in a first frame period of the solid-state image sensor means; and X-ray control means for controlling the pulse width and timing of each X-ray pulse emitted from the source, so that the source emits an X-ray pulse having the determined width during each subsequent frame period after the first frame period.

Also in accordance with the present invention there is provided a diagnostic X-ray apparatus for emitting X-ray pulses for examining an object. The apparatus comprises a source for emitting X-ray pulses to the object; optical imaging means for receiving the X-ray pulses through the object and converting the X-ray pulses to corresponding optical images; video means, including a solid-state image sensor means, for detecting the optical images produced by the optical imaging means and for converting the optical images into a series of video signals; synchronizing means for generating field shift pulses for driving the solid-state imaging sensor means at a predetermined rate; pulse width determining means for determining a pulse width of the X-ray pulses; and X-ray control means for controlling the pulse width and timing of each X-ray pulse emitting from the source, so that the source emits an X-ray pulse having the determined pulse width in a same field period of each frame period.

Using the present invention, it is possible to obtain a proper contrast radiographic image successively without a preliminary X-ray emission.

BRIEF DESCRIPTION OF THE DRAWINGS

FIG. 3 is a schematic diagram of a plurality of picture elements of a solid-state image sensing device.

DETAILED DESCRIPTION OF THE PREFERRED EMBODIMENTS

Embodiments of a diagnostic X-ray apparatus according to the present invention will be described hereinafter with reference to the accompanying drawings.

Figure 1:
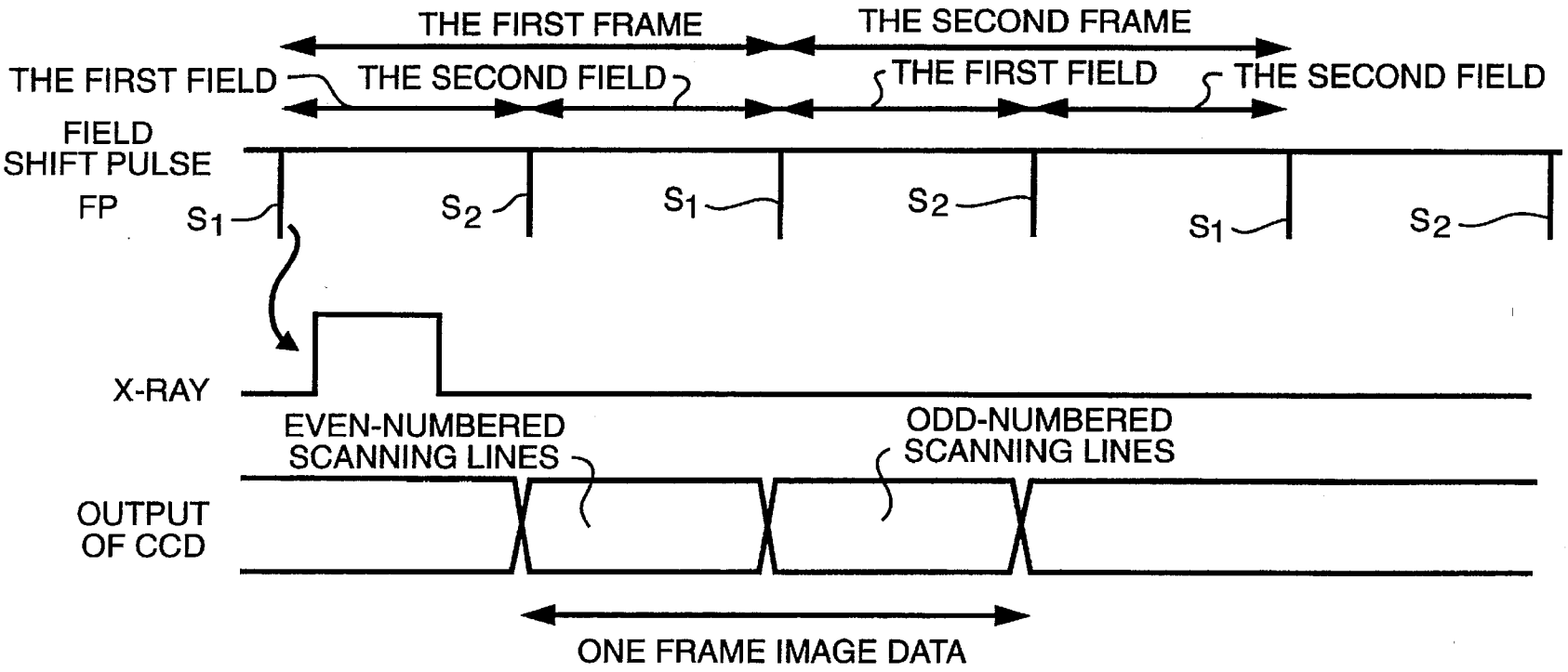
FIG. 1 is an example of a timing chart of an X-ray emission in a conventional diagnostic X-ray apparatus which uses a solid-state image sensing device which performs interlaced scanning in a frame storage mode.
Figure 2:
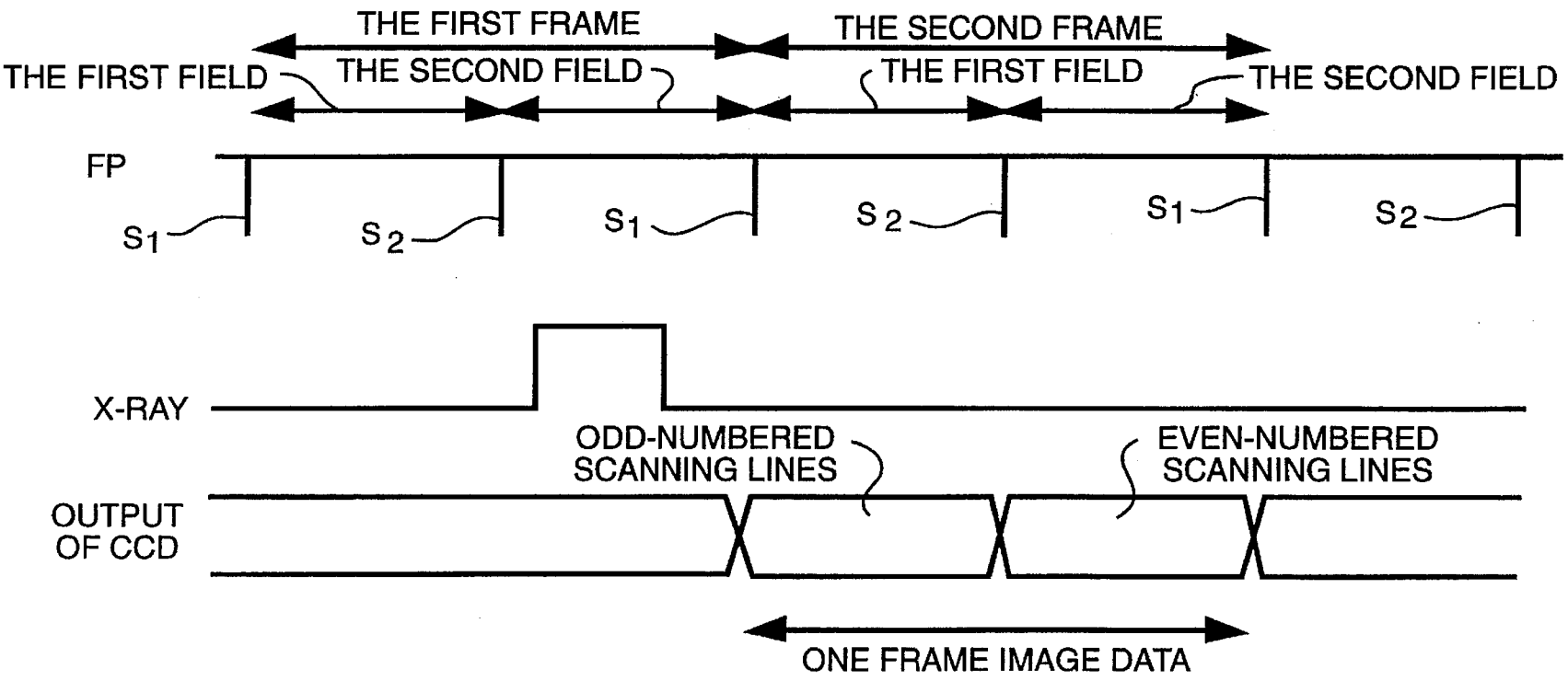
FIG. 2 is another example of a timing chart of an X-ray emission in a conventional diagnostic X-ray apparatus which uses a solid-state image sensing device which performs interlaced scanning in a frame storage mode.
Figure 4:
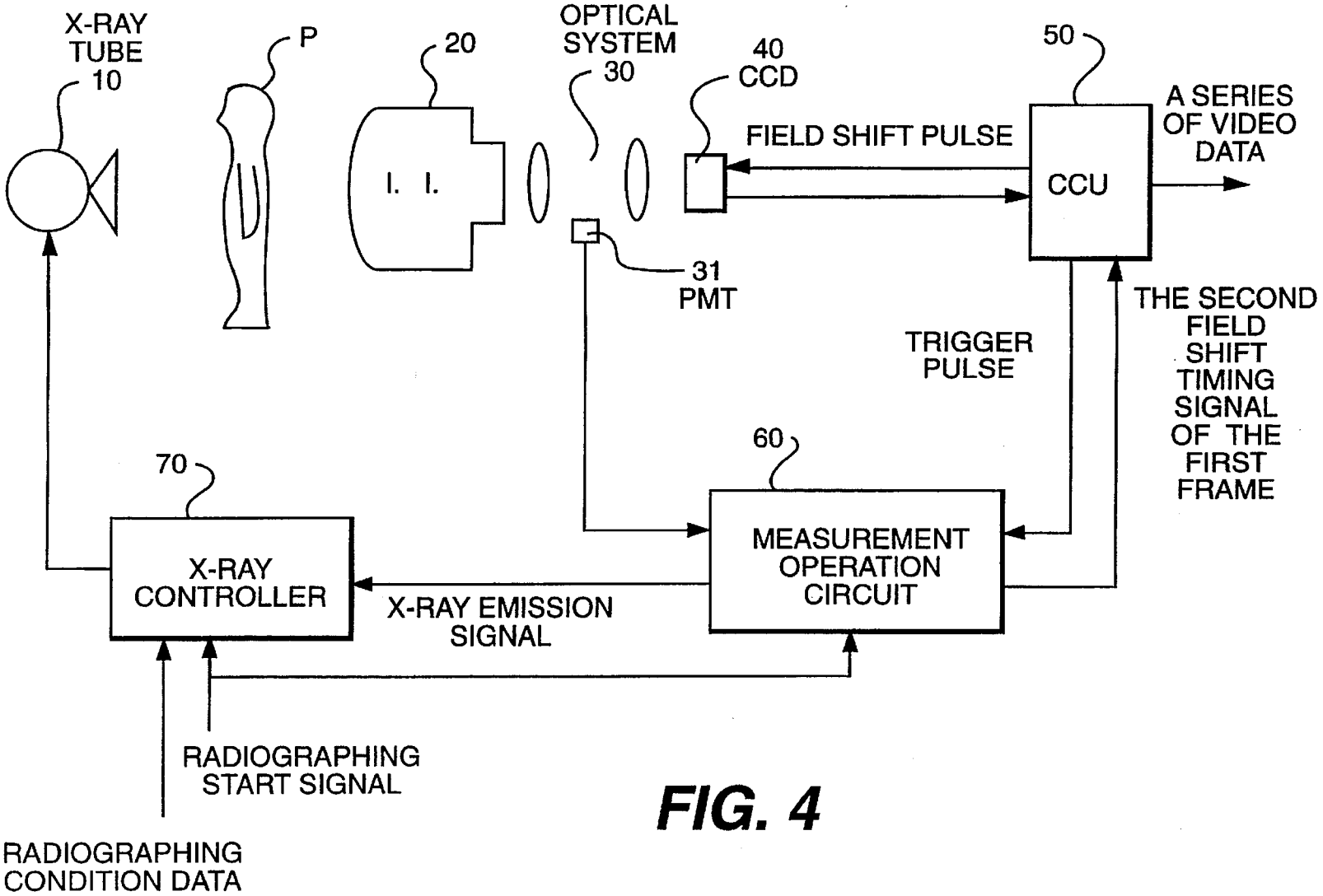
FIG. 4 is a block diagram of an embodiment of diagnostic X-ray apparatus which uses a solid-state image sensing device which performs interlaced scanning in a field storage mode according to the present invention.

FIG. 4 is a block diagram of an embodiment of the diagnostic X-ray apparatus which uses a solid-state image sensing device which performs interlaced scanning in a field storage mode according to the present invention. The diagnostic X-ray apparatus comprises an X-ray tube 10, an I.I. 20, an optical system 30 including a photomultiplier tube (PMT) 31, a CCD 40 performing in a field storage interlace mode, a camera control unit (CCU) 50, a measurement operation circuit 60, and an X-ray controller 70.

An emission period and timing of an X-ray pulse emitted from X-ray tube 10 are controlled by X-ray controller 70. X-ray controller 70 receives an X-ray emission signal from measurement operation circuit 60. Measurement operation circuit 60 receives an output from PMT 31 as well as trigger pulses from CCU 50 which signify the beginning of each frame period of the CCD 40. CCU 50 receives outputs of CCD 40 and measurement operation circuit 60. CCU 50 includes a field shift pulse generator and provides field shift pulses to CCD 40. A series of video signals generated by CCU 50 are displayed as a radiographic image on a monitor. Various kinds of image processing of the series of video signals are performed, as needed.

Figure 5:
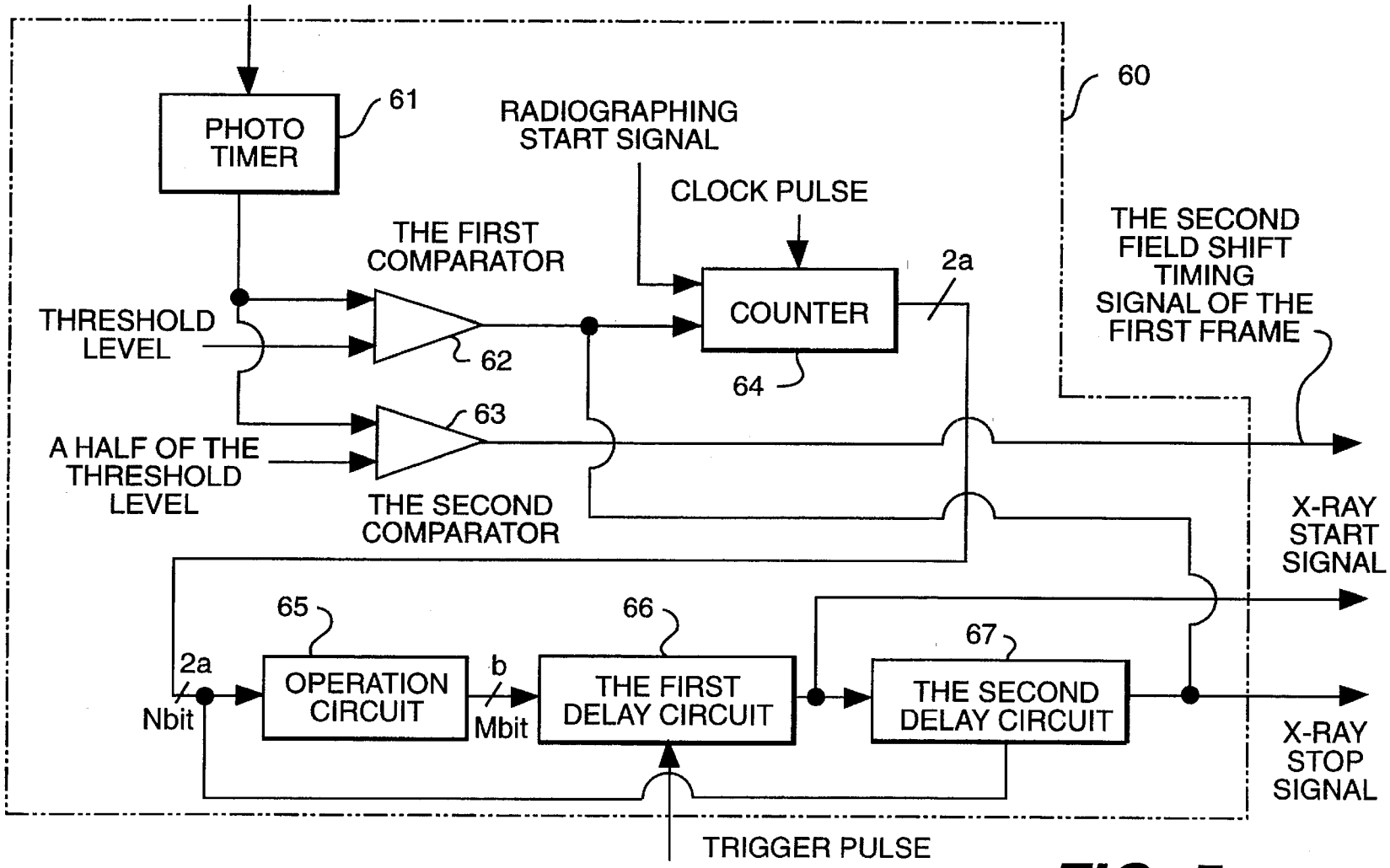
FIG. 5 is a detailed block diagram of a measurement operation circuit shown in FIG. 4.

FIG. 5 is a detailed block diagram of the measurement operation circuit 60. The measurement operation circuit 60 comprises a photo timer 61 coupled to PMT 31 for integrating the output of PMT 31, a first comparator 62 for comparing a predetermined threshold level with the output of photo timer 61, and a second comparator 63 for comparing a half of the predetermined threshold level with the output of photo timer 61. A counter 64 is coupled to the first comparator 62 and receives clock pulses having a predetermined frequency and a radiographing start signal. An operating circuit 65 is coupled to counter 64 for operating the starting timing of the X-ray emission beginning with the second frame of CCD 40. A first delay circuit 66 is coupled to operating circuit 65 for delaying the trigger pulse generated by CCU 50 for a period according to the output of operating circuit 65. A second delay circuit 67 is coupled to the first delay circuit 66 for delaying the output of the first delay circuit 66 for a period according to the output of counter 64.

Figure 6:
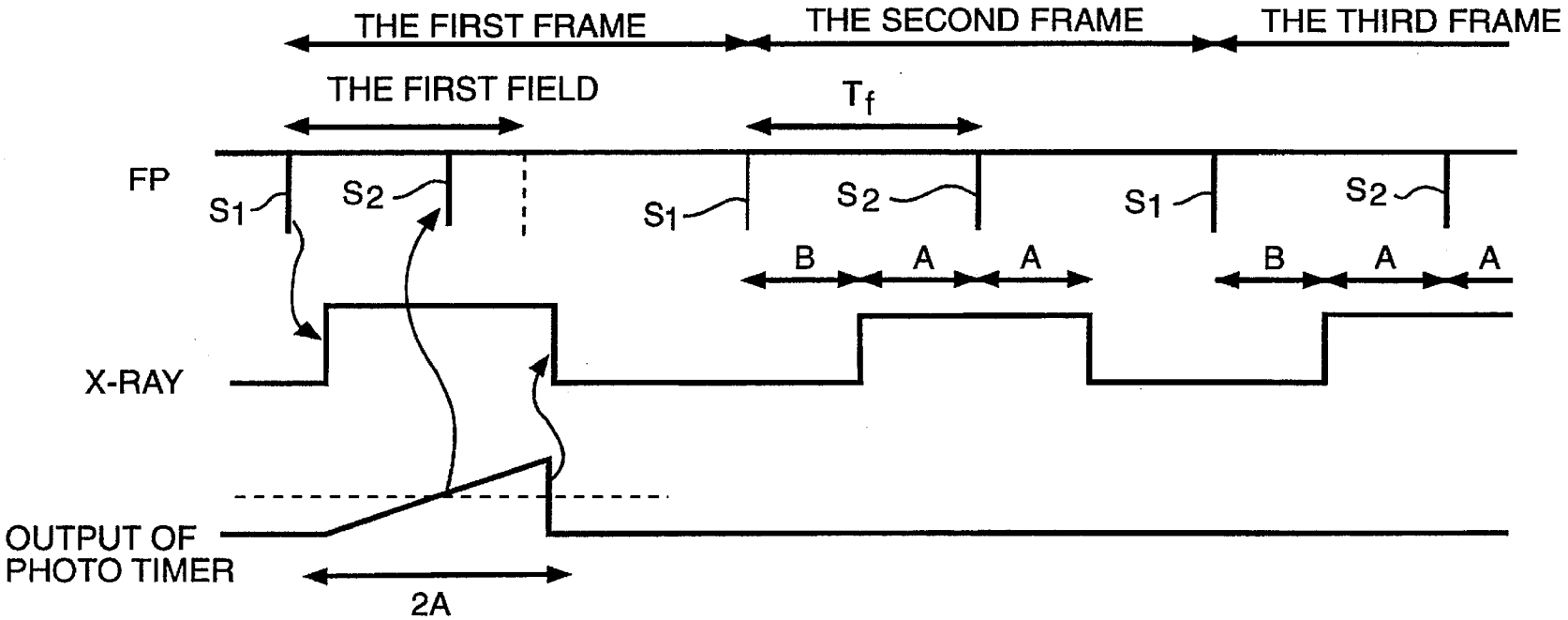
FIG. 6 is an example of a timing chart of X-ray emissions in the diagnostic X-ray apparatus shown in FIG. 4.

FIG. 6 is an example of a timing chart of X-ray emissions in the diagnostic X-ray apparatus shown in FIG. 4. FP is a field shift pulse signal in FIG. 6, S1 is the first field shift pulse and S2 is the second field shift pulse.

In operation, an operator provides to X-ray controller 70 radiographing condition data including a maximum pulse width of an X-ray pulse which is shorter than one frame period of CCD 40. The radiographing condition data also includes a tube voltage and a tube current. The operator provides a radiographing start signal to X-ray controller 70, such that X-ray pulses are emitted successively from X-ray tube 10 onto an object P.

In the first X-ray pulse emission, a suitable pulse width of the X-ray pulse for obtaining proper contrast of the radiographic image is decided as follows. When a high voltage according to the radiographing condition data is applied to X-ray tube 10 from X-ray controller 70, X-ray pulses are emitted from X-ray tube 10 toward the object P. X-ray pulses transmitted through the object P are converted by I.I. 20 to an optical image. The optical image is transmitted through optical system 30 including PMT 31 to CCD 40. Photo timer 61 integrates the output of PMT 31. When the output of photo timer 61 reaches one-half of the predetermined threshold level, the second comparator 63 provides the second field shift timing signal of the first frame to CCU 50. The predetermined threshold level is an output level of photo timer 61 for obtaining a proper contrast radiographic image. CCU 50 generates field shift pulse S2. When the output of photo timer 61 reaches the predetermined threshold level, the first comparator 62 provides the X-ray stop signal to X-ray controller 70 and counter 64.

The emission start timing of each X-ray pulse commencing with the second frame is decided as follows. Counter 64 counts the emission period of the X-ray pulse in the first frame and provides, the value 2A (N bit digital value) corresponding to the emission period of the X-ray pulse to operating circuit 65 which corresponds to the above-identified pulse width. Operating circuit 65 calculates B=Tf-A (A=2A/2). The value Tf represents one field period of CCD 40. The value B is an M bit digital value corresponding to the X-ray emission start time measured from the first field shift pulse S1 commencing in the second frame. The trigger pulse is provided to the first delay circuit 66 from CCU 50 at the beginning of the frame and, occurring at the beginning of the frame, has the timing of the first field shift pulse S1. The first delay circuit 66 delays the trigger signal having the timing of the field shift pulse S1 for the value B and generates the X-ray stop signal. The second delay circuit 67 delays X-ray stop signal for the emission period 2A and generates the X-ray stop signal. This X-ray stop signal is provided to X-ray controller 70 and X-ray emission is stopped. In the second frame, field shift pulse S2 is generated upon the time A elapsing after the X-ray emission start time. As a result, the total dosage of X-rays in the first field is the same as the total dosage of X-rays in the second field. In the third frame, the X-ray pulse is emitted in the same way as for the second frame.

In the above embodiment, it is possible to obtain proper contrast of each radiographic image successively without preliminary X-ray emission.

In the above embodiment, the pulse width of the X-ray pulses is decided according to the output of photo timer 61. However, it is possible that the pulse width of the X-ray pulse could be decided according to a condition of fluoroscoping before radiography.

Figure 7:
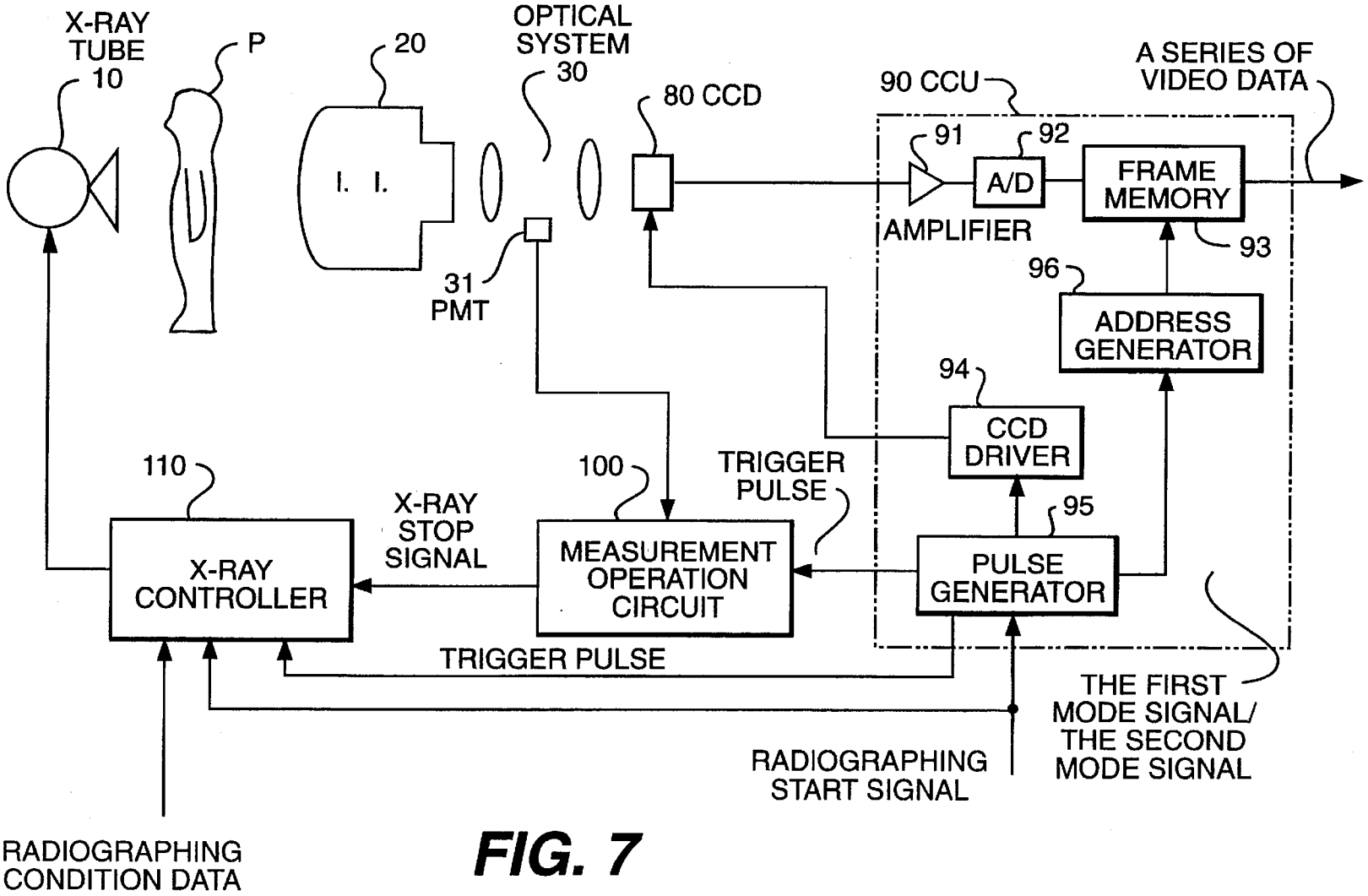
FIG. 7 is a block diagram of an embodiment of diagnostic X-ray apparatus which uses a solid-state image sensing device which performs interlaced scanning in a frame storage mode according to the present invention.

FIG. 7 is a block diagram of an embodiment of the diagnostic X-ray apparatus which uses a solid-state image sensing device which performs interlaced scanning in a frame storage mode according to the present invention. The diagnostic X-ray apparatus comprises X-ray tube 10, I.I. 20, optical system 30 including PMT 31, a CCD 80 performing in a frame storage interlace mode, a CCU 90, a measurement operation circuit 100, and an X-ray controller 110.

The emission period and timing of an X-ray pulse emitted from X-ray tube 10 are controlled by X-ray controller 110. X-ray controller 110 receives an X-ray stop signal from measurement operation circuit 100. A trigger pulse is generated by a pulse generator 95 which is included in CCU 90 in response to a radiographing start signal. Measurement operation circuit 100 receives the output from PMT 31 and the trigger pulse from pulse generator 95. CCU 90 comprises an amplifier 91 for amplifying the output of CCD 80, an A/D converter 92 for converting the output of amplifier 91 into corresponding digital signals, a frame memory 93 for receiving the output of A/D converter 92 and composing one frame image from one odd-numbered field image and one even-numbered field image, a CCD driver 94 for driving CCD 80, a pulse generator 95 for controlling CCD driver 94, and an address generator 96 coupled to pulse generator 95 for providing address data to frame memory 93. The output of frame memory 93 is provided to a monitor which performs non-interlaced scanning.

Figure 8:
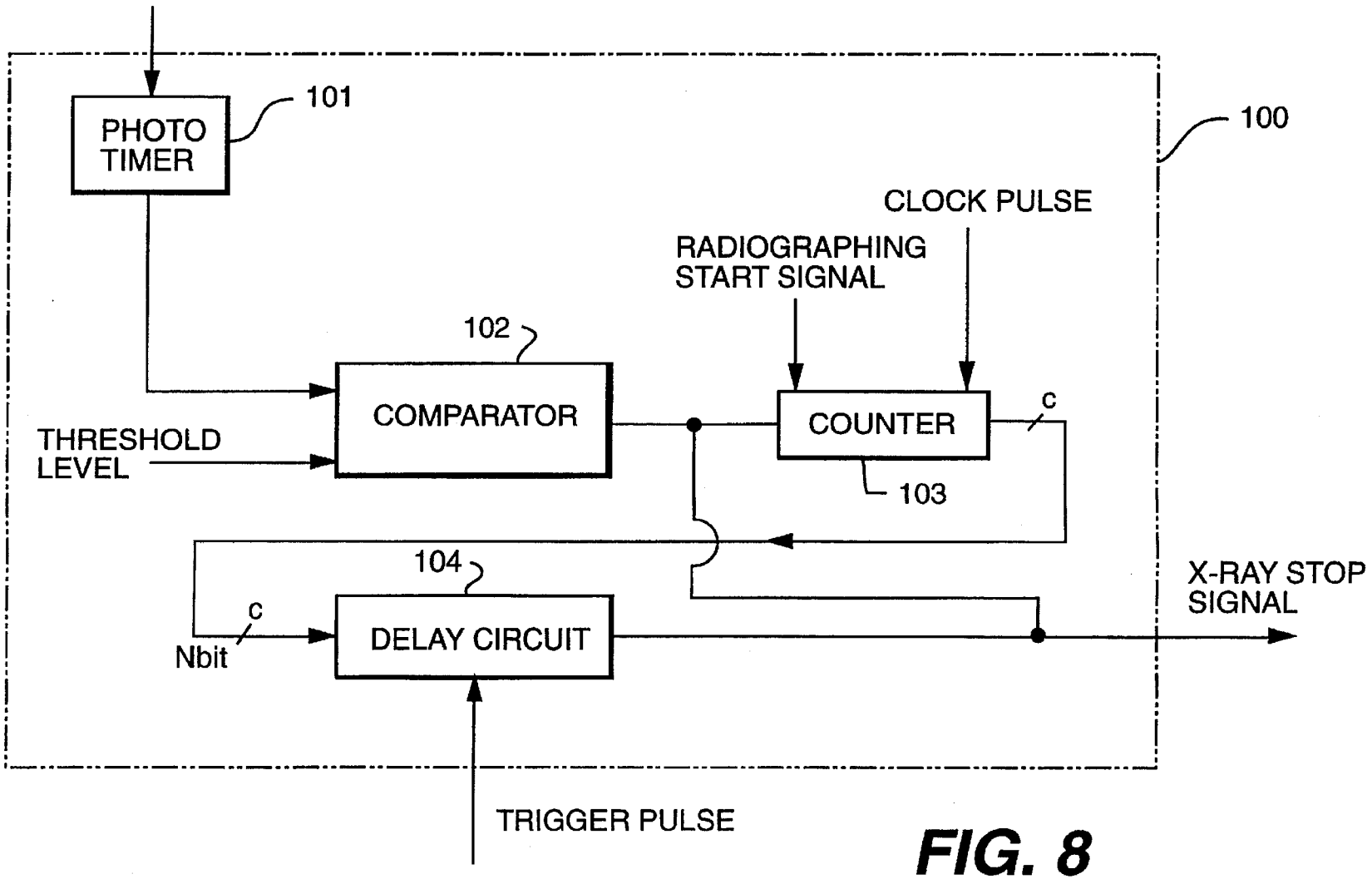
FIG. 8 is a detailed block diagram of a measurement operation circuit shown in FIG. 7.

FIG. 8 is a detailed block diagram of the measurement operation circuit 100. The measurement operation circuit 100 comprises a photo timer 101 coupled to PMT 31 for integrating the output of PMT 31, a comparator 102 for comparing a predetermined threshold level with the output of photo timer 101, a counter 103 coupled to comparator 102 and receiving clock pulses having a predetermined frequency and the radiographing start signal, a delay circuit 104 coupled to counter 103 for delaying the trigger pulse generated by CCU 90 for a period according to the output of counter 103.

In operation, an operator provides to X-ray controller 110 radiographing condition data including a pulse width of the X-ray pulse which is less than one field period of CCD 80. The radiographing condition data also includes a tube voltage and a tube current. The operator provides the radiographing start signal to X-ray controller 110, such that X-ray pulses are emitted successively from X-ray tube 10 onto an object P.

Figure 9:
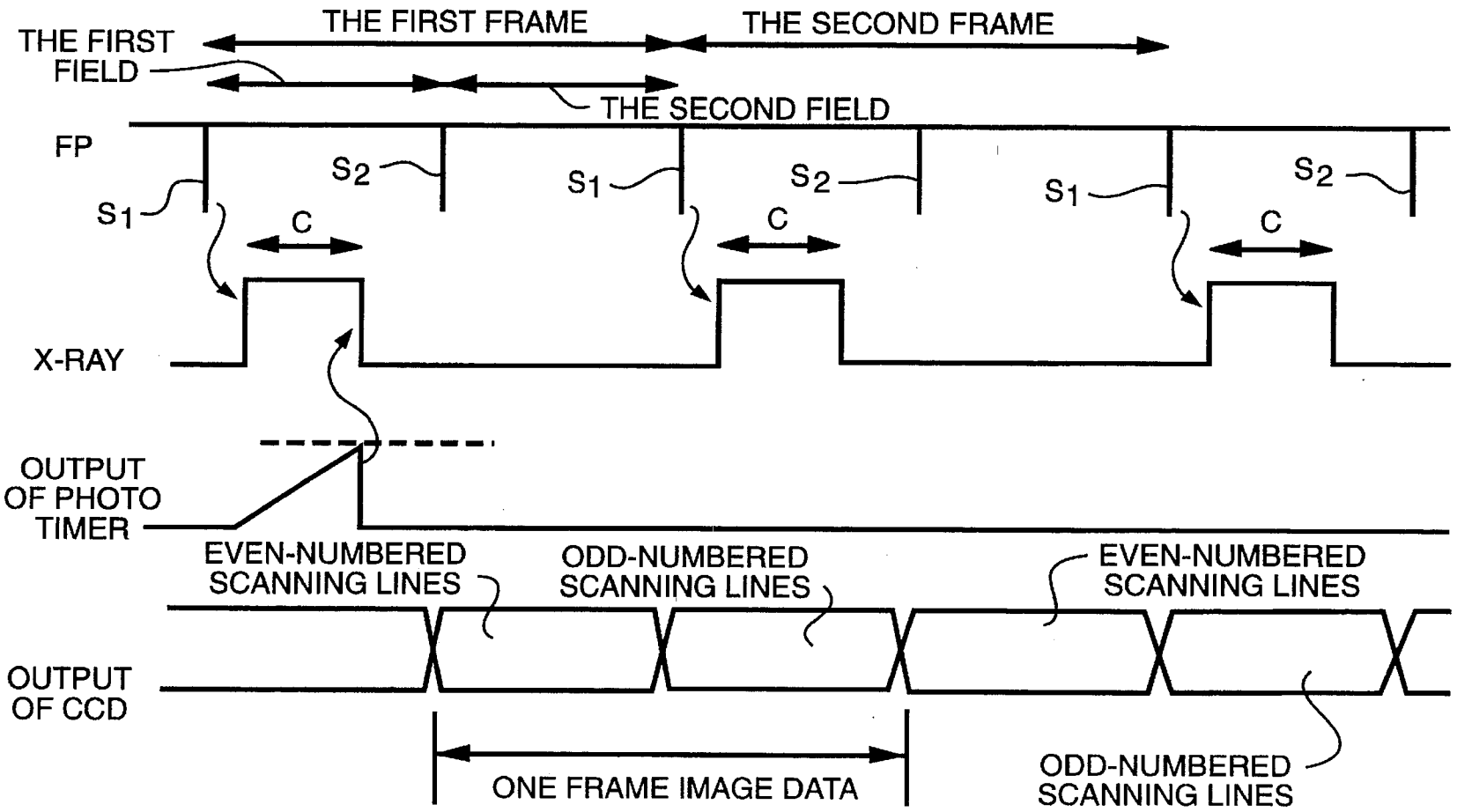
FIG. 9 is an example of a timing chart of X-ray emissions in the diagnostic X-ray apparatus shown in FIG. 7.
Figure 10:
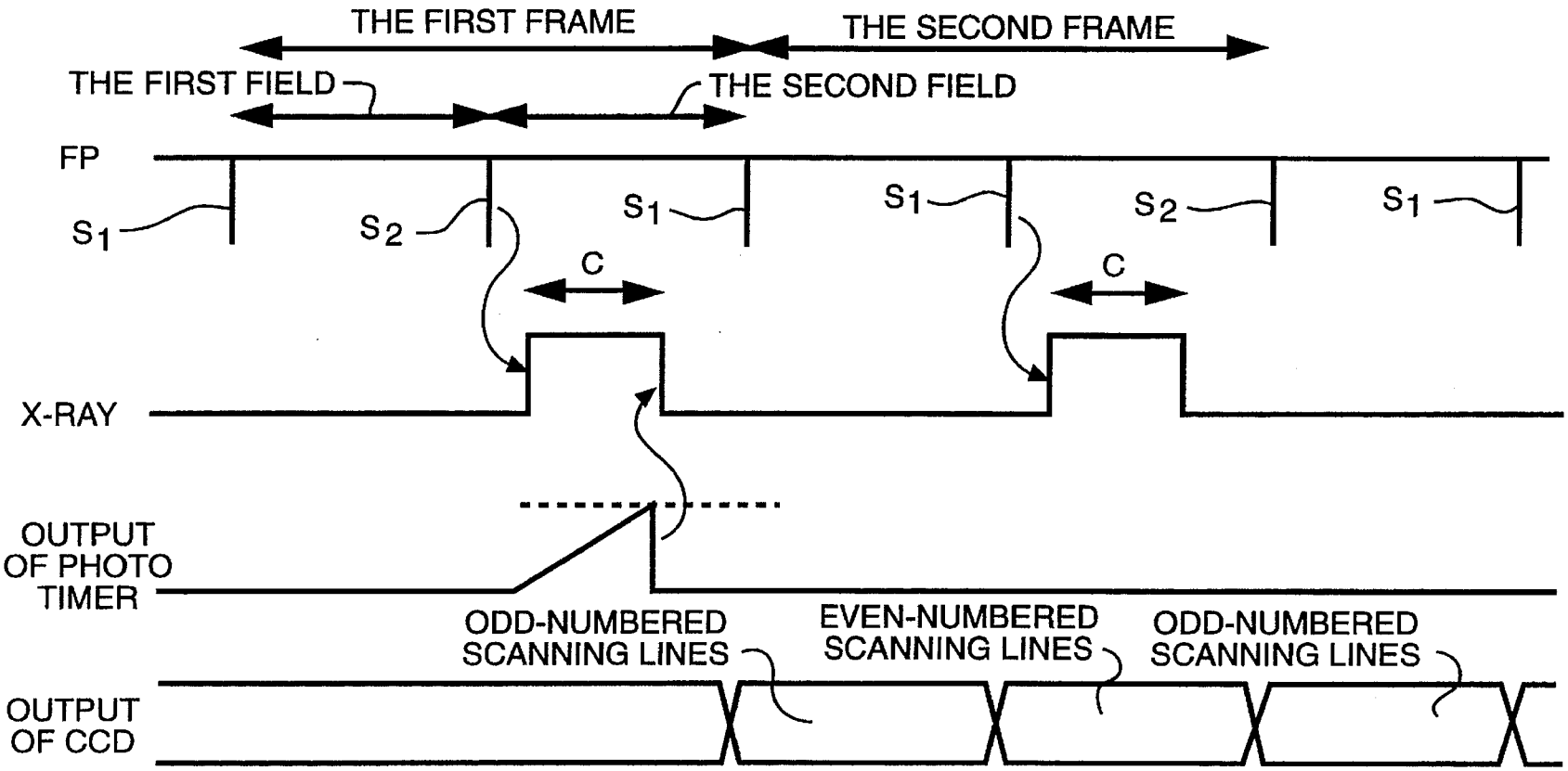
FIG. 10 is another example of a timing chart of X-ray emissions in the diagnostic X-ray apparatus shown in FIG. 7.

In this embodiment, a timing chart of X-ray emissions has two different cases as shown in FIG. 9 and FIG. 10. In the case of FIG. 9, X-ray pulses are emitted in the first field of each frame. In the case of FIG. 10, X-ray pulses are emitted in the second field of each frame.

The case as shown in FIG. 9 is as follows.

When a high voltage according to the radiographing condition data is applied to X-ray tube 10 from X-ray controller 110, X-ray pulses are emitted from X-ray tube 10 onto an object P. X-ray pulses transmitted through the object P are converted by I.I. 20 to an optical image. The optical image is transmitted through optical system 30 including PMT 31 to CCD 80. In this case, an X-ray pulse is emitted in the first field of the first frame at first. Pulse generator 95 recognizes the X-ray pulse is emitted in the first field of the first frame and provides the first mode signal, which signifies that the X-ray pulse is emitted in the first field, to address generator 96. Address generator 96 generates address data for writing the output of A/D converter 92 to frame memory 93 according to the first mode signal. While the X-ray pulse is generated, photo timer 101 integrates the output of PMT 31. When the output of photo timer 101 reaches the predetermined threshold level, comparator 102 provides the X-ray stop signal which signifies that the output of photo timer 101 has reached the predetermined threshold level to X-ray controller 110 and counter 103. The predetermined threshold level is an output level of photo timer 101 for obtaining a proper contrast radiographic image. The charges of the pixels on the even-numbered horizontal scanning lines of CCD 80 are read in the second field of the first frame and the charges of the pixels on the odd-numbered horizontal scanning lines of CCD 80 are read in the first field of the second frame. Frame memory 93 composes one frame from one odd-numbered field image and one even-numbered field image.

X-ray pulse emission timing and pulse width of X-ray pulse commencing with the second frame is decided as follows. Counter 103 counts the emission period of the X-ray pulse in the first frame and provides the value C (N bit digital value) corresponding to the emission period of the X-ray pulse to delay circuit 104. In the mode shown in FIG. 9, the trigger pulse is generated at the beginning of the first field of each frame and has the same timing as field shift pulse S1. Pulse generator 95 provides the trigger pulse having the timing of the field shift pulse S1 to delay circuit 104 and X-ray controller 110 and an X-ray pulse is emitted from X-ray tube 10. Delay circuit 104 delays the trigger pulse for the period C and generates the X-ray stop signal. This X-ray stop signal is provided to X-ray controller 110 and X-ray emission is stopped. In the third frame, the X-ray pulse is emitted in the same way as in the second frame.

The case as shown in FIG. 10 is as follows.

When a high voltage according to the radiographing condition data is applied to X-ray tube 10 from X-ray controller 110, X-ray pulses are emitted from X-ray tube 10 onto an object P. X-ray pulses transmitted through the object P are converted by I.I. 20 to an optical image. The optical image is transmitted through optical system 30 including PMT 31 to CCD 80. In this case, an X-ray pulse is emitted in the second field of the first frame at first. Pulse generator 95 recognizes that the X-ray pulse is emitted in the second field of the first frame and provides the second mode signal, which signifies that the X-ray pulse is emitted in the second field, to address generator 96. Address generator 96 generates address data for writing the output of A/D converter 92 to frame memory according to the second mode signal. While the X-ray pulse is generated, photo timer 101 integrates the output of PMT 31. When the output of photo timer 101 reaches the predetermined threshold level, comparator 102 provides the X-ray stop signal which signifies that the output of photo timer 101 has reached the predetermined threshold level to X-ray controller 110 and counter 103. The predetermined threshold level is an output level of photo timer 101 for obtaining proper contrast of the radiographic image. The charges of the pixels on the odd-numbered horizontal scanning lines of CCD 80 are read in the first field of the second frame and the charges of the pixels on the even-numbered horizontal scanning lines of CCD 80 are read in the second field of the second frame. Frame memory 93 composes one frame image from one odd-numbered field image and one even-numbered field image.

X-ray pulse emission timing and the pulse width of the X-ray pulse commencing with the second frame is decided as follows. Counter 103 counts the emission period of the X-ray pulse in the first frame and provides the value C (N bit digital value) corresponding to the emission period of the X-ray pulse to delay circuit 104. In the mode shown FIG. 10, the trigger pulse (FIGS. 7 and 8) is generated at the beginning of the second field in each frame and has the same timing as field shift pulse S2. Pulse generator 95 provides the trigger pulse having the timing of field shift pulse S2 to delay circuit 104 and X-ray controller 110 and an X-ray pulse is emitted from X-ray tube 10. Delay circuit 104 delays the trigger pulse for the value C and generates the X-ray stop signal. This X-ray stop signal is provided to X-ray controller 110 and X-ray emission is stopped. In the third frame, the X-ray pulse is emitted in the same way as in the second frame.

In the above embodiment, it is possible to obtain a proper contrast radiographic image successively without preliminary X-ray emission. Moreover, when the field image signal is stored in a frame memory, it is possible that an exact frame image signal is provided.

Figure 11:
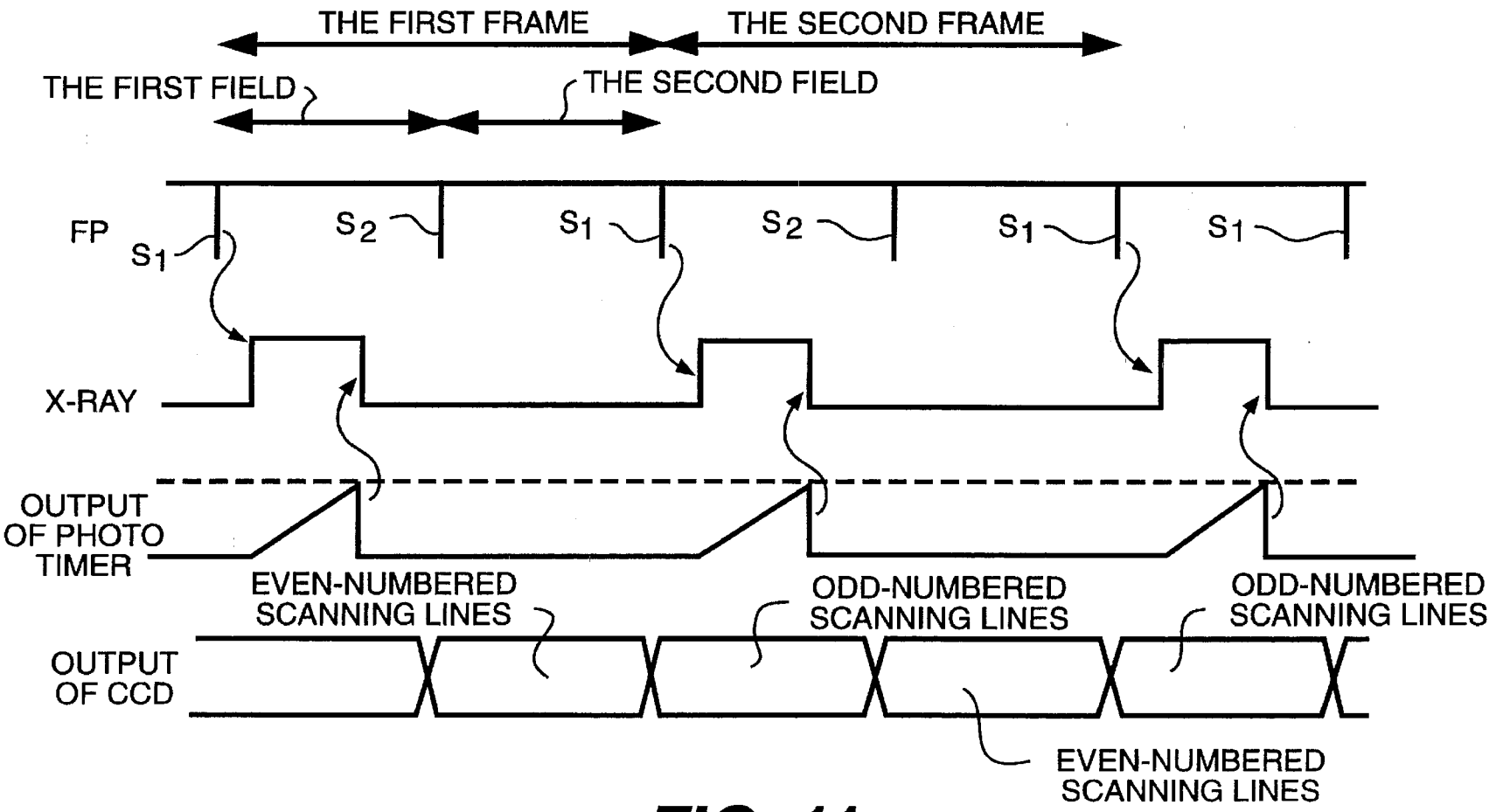
FIG. 11 is an example of a timing chart of X-ray emissions in a modified form of the diagnostic X-ray apparatus shown in FIG. 7.

In the above embodiment, it is possible to decide in which field of each frame the X-ray pulse is emitted, such that controlling address generator 96 is easier. Moreover, it is possible to decide the pulse width of the X-ray pulse according to a condition of fluoroscoping before radiography. Moreover, as shown in FIG. 11, it is possible to decide the pulse width of the X-ray pulse by a photo timer system in each frame.

It will be apparent to those skilled in the art that various modifications and variations can be made in the disclosed embodiments without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A diagnostic X-ray apparatus emitting X-ray pulses for examining an object, comprising:

a source for emitting X-ray pulses toward the object;

imaging means for receiving the X-ray pulses through the object and converting the X-ray pulses to corresponding optical images;

camera means, including a solid state image sensor means, for detecting the optical images produced by said imaging means and for converting the optical images into a series of video signals, which performs interlaced scanning in a field storage mode;

synchronizing means for generating field shift pulses for driving said solid state imaging sensor means at a predetermined rate;

pulse width determining means for determining a pulse width of the X-ray pulses in a first frame period of said solid state image sensor means so that quantity of X rays in the first frame period entering the visible imaging means is a predetermined value; and X-ray control means for controlling the emission of each X-ray pulse from said source so that said source emits an X-ray pulse having the determined width during each subsequent frame period after the first frame period, and so that the time of emitting X rays in the first field period substantially equals time of emitting X rays in second field period.

2. A diagnostic X-ray apparatus according to claim 1, wherein the X-ray control means includes means for providing an X-ray start signal after a predetermined delay from a first field shift pulse during each subsequent frame period.

3. A diagnostic X-ray apparatus according to claim 2, wherein the X-ray control means includes means for generating an X-ray stop signal after a period of one-half the determined duration following a second field shift pulse during each subsequent frame period.

4. A diagnostic X-ray apparatus according to claim 1, wherein the pulse width of each said X-ray pulse emitted by said source is less than one frame period of said solid state image means.

5. A diagnostic X-ray apparatus according to claim 1, wherein said pulse width determining means includes a photo timer for measuring a total quantity of X rays in each frame period of said solid state image means.

6. A diagnostic X-ray apparatus according to claim 5, wherein said pulse width determining means includes means for comparing the total quantity of X rays measured by said photo timer with a predetermined value to determine the pulse width of the X-ray pulse.

7. A diagnostic X-ray apparatus according to claim 6, wherein said synchronizing means includes means for generating said field shift pulse at the first frame period when the total quantity of X rays measured by said photo timer becomes one-half of the predetermined value.

8. A diagnostic X-ray apparatus according to claim 1 wherein the X-ray control means includes means for controlling said source to emit each X-ray pulse after a first field shift pulse of each frame period of said image sensor means.

9. A diagnostic X-ray apparatus according to claim 8 wherein said X-ray control means controls said source to emit each X-ray pulse after a second field shift pulse of each frame period.

10. A diagnostic X-ray apparatus emitting X-ray pulses for examining an object, comprising:

a source for emitting X-ray pulses toward the object;

imaging means for receiving the X-ray pulses through the object and converting the X-ray pulses to corresponding optical images;

camera means, including a solid state image sensor means, for detecting the optical images produced by said imaging means and for converting the optical images into a series of video signals, which performs interlaced scanning in a frame storage mode;

memory control means for generating address data which is determined by X-ray emitting timing in the frame period;

memory means for storing the optical image based on the series of video signals and corresponding to said address data;

synchronizing means for generating field shift pulses for driving said solid state imaging sensor means at a predetermined rate;

pulse width determining means for determining a pulse width of the X-ray pulses; and X-ray control means for controlling the emission of each X-ray pulse from said source, so that said source emits an X-ray pulse having the determined pulse width in a same field period of each frame period.

11. A diagnostic X-ray apparatus according to claim 10, wherein the determined pulse width of said X-ray pulse is less than one field period of said solid state image means.

12. A diagnostic X-ray apparatus according to claim 10, wherein said X-ray control means includes means for controlling said source to emit X-ray pulses having the determined pulse width determined by said pulse width determining means during a first frame period in each frame period commencing with the second frame period.

13. A diagnostic X-ray apparatus according to claim 10, wherein said pulse width determining means includes a photo timer for measuring a total quantity of X rays in each frame period of said solid state image sensor means.

14. A diagnostic X-ray apparatus according to claim 13, wherein said pulse width determining means includes means for comparing the total quantity of X rays measured by said photo timer with a predetermined value to determine the pulse width of the X-ray pulse.

15. A diagnostic X-ray apparatus according to claim 10, wherein said X-ray control means includes means for controlling said source to start emitting X-ray pulses when a selected one of said field shift pulses is generated by said synchronizing means and to stop emitting X-ray pulses on the basis of said total quantity of X rays measured by said photo timer.

16. A diagnostic X-ray apparatus according to claim 10, wherein said video means includes an A/D converter for converting analog signals into corresponding digital signals, so that said series of video signals generated by said video means are digital video signals.

17. A diagnostic X-ray apparatus according to claim 16, further comprising a frame memory for storing said digital video signals and an address generator for generating address data for storing said digital video signals to said frame memory, said address generator generating address data according to an identity of the same field period in which said X-ray pulse is emitted.

18. A method for emitting X-ray pulses from a diagnostic X-ray apparatus for examining an object, comprising the steps of:

emitting X-ray pulses toward the object;

receiving the X-ray pulses through the object and converting the X-ray pulses to corresponding optical images;

detecting with a solid state image sensor means the optical images and converting the optical images into a series of video signals;

generating field shift pulses for driving said solid state imaging sensor means at a predetermined rate;

determining a pulse width of the X-ray pulse in a first frame period of said solid state image sensor means; and controlling the pulse width and timing of each emitted X-ray pulse so that each X-ray pulse has the determined width during each subsequent frame period after the first frame period.

19. A diagnostic X-ray apparatus emitting X-ray pulses for examining an object, comprising:

a source for emitting X-ray pulses toward the object;

visible imaging means for receiving the X-ray pulses through the object and converting the X-ray pulses to corresponding optical images;

camera means, including a solid state image sensor means, for detecting the optical images produced by said visible imaging means and converting the optical images into a series of video signals, which performs interlaced scanning in a field storage mode;

memory control means for generating address data which is determined by X-ray emitting timing in the frame period;

memory means for storing the optical image based on the series of video signals and corresponding to said address data;

detecting means for detecting a quantity of X rays in each X-ray pulse received by the visible imaging means;

synchronizing means for generating field shift pulses and for driving said solid state imaging sensor means; and X-ray control means for controlling period and timing of the X-ray pulses emitted from said source so that the source stops emitting the X-ray pulses when the quantity of X rays received by the visible imaging means after the field shift pulse reaches a predetermined value.

* * * * *